US005469785A

United States Patent [19]

Goings

[11] Patent Number: 5,469,785

[45] Date of Patent: Nov. 28, 1995

[54] COMBINATION CAN CRUSHING AND RETRIEVING DEVICE

[76] Inventor: William L. Goings, 853 Weedel La., Arnold, Mo. 63010

[21] Appl. No.: 421,517

[22] Filed: Apr. 13, 1995

[51] Int. Cl.[6] ..... B30B 7/00; B30B 9/32

[52] U.S. Cl. ..... 100/137; 100/233; 100/295; 100/299; 100/902; 294/19.1; 294/104

[58] Field of Search ..... 100/137, 233, 100/278, 295, 299, 902; 294/19.1, 50.9, 104

[56] References Cited

U.S. PATENT DOCUMENTS

| | | | |
|---|---|---|---|
| 2,015,109 | 9/1935 | Hays | 294/50.9 |
| 2,025,254 | 12/1935 | Stuart | 294/50.9 |
| 3,667,386 | 6/1972 | Workman | 100/902 |
| 3,776,129 | 12/1973 | Carlson | 100/98 R |
| 3,937,512 | 2/1976 | Baughman | 294/50.9 |
| 3,988,978 | 11/1976 | Flick | 100/35 |
| 4,192,539 | 3/1980 | Broyles et al. | 294/19.1 |
| 4,606,266 | 8/1986 | Hyman, Sr. | 100/233 |
| 4,938,516 | 7/1990 | Temple | 294/19.1 |
| 5,038,677 | 8/1991 | Wittman et al. | 100/137 |
| 5,232,256 | 8/1993 | Forbes | 294/19.1 |

*Primary Examiner*—Stephen F. Gerrity
*Attorney, Agent, or Firm*—Harpman & Harpman

[57] ABSTRACT

A combination can crushing and retrieving device having a movable gripping and crushing jaw means. An aluminum can can be gripped and positioned within the device for pivotal engagement of a crushing jaw by pressure inserted thereon by the user's foot. The can is crushed and folded and can be transported by the device for release and disposal as well as initial gripping of the can for positioning within the crushing device.

5 Claims, 3 Drawing Sheets

COMBINATION CAN CRUSHING AND RETRIEVING DEVICE

BACKGROUND OF THE INVENTION

1. Technical Field

This invention relates to mechanical devices used to grip and crush containers into flat easily stored and transported configurations.

2. Description of Prior Art

Prior art devices of this type have relied on a variety of different can crushing structures, see for example U.S. Pat. Nos. 4,606,266, 3,988,978 and 3,776,129.

In U.S. Patent ending in 266 a can crusher and exercise device is disclosed which utilizes spring loaded jaws which have been adapted as a can crusher. The can is positioned within the crusher and the foot is then used to activate the can crushing jaws which are spring urged crushing the can and then returning to its opened position.

In U.S. Patent ending in 978 a beverage can folder is disclosed in which a foot portion of the device is positioned on the middle portion of an aluminum beer can which causes the ends of the can to angle inwardly as the center of the can is flattened out with the ends of the can folded over by a plate which is telescopically movable on the main support stock.

In U.S. Patent ending in 129 a container crusher is disclosed which has a base platform on which the can is positioned and a pivoted jaw configuration which engages the end of the can folding and crushing it under a plate by pressure applied to the device by the user's foot.

SUMMARY OF THE INVENTION

A self-contained combination can crusher and retrieving device that can crush containers which are positioned between a staging platform base and a movable jaw. Gripping means activated by handle grip advances the movable jaw to engage and hold the can within. The crushing pressure is achieved by foot pressure applied to the movable jaw by the user which pivotally advances against the can, crushing the can between the jaw and the base.

DESCRIPTION OF THE PREFERRED EMBODIMENT

Figure 3:
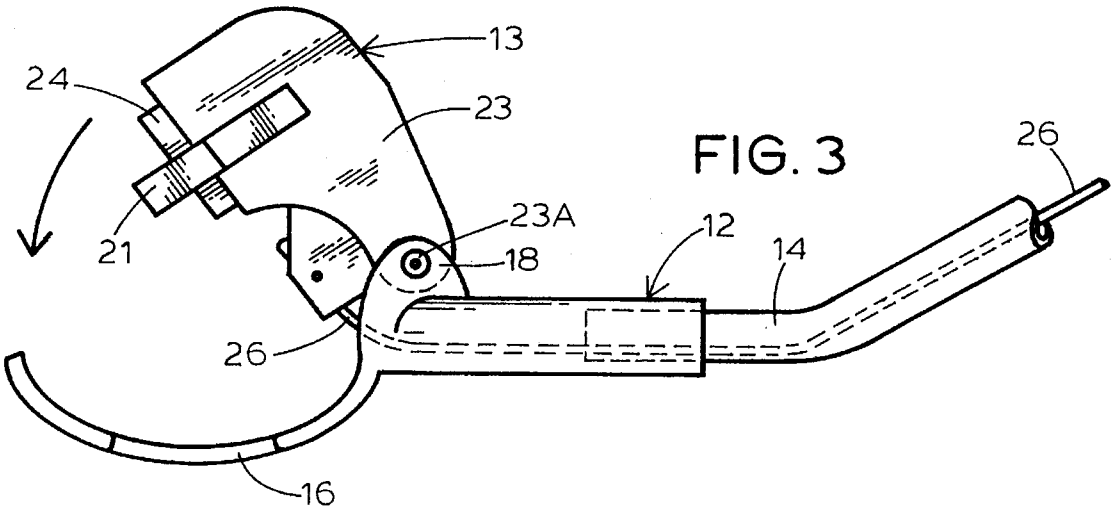
FIG. 3 is a large side elevational view of the lower portion of the invention on lines 3—3 of FIG. 2.
Figure 6:
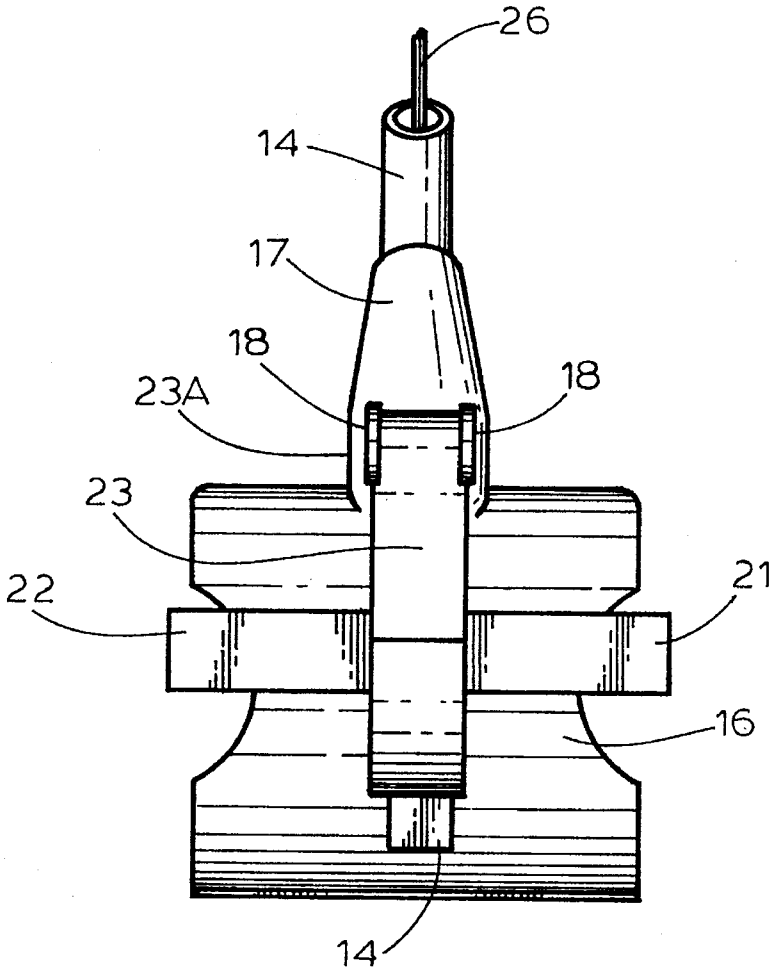
FIG. 6 is an enlarged top plan view of the lower portion of the invention thereof.

Referring to FIGS. 1–6 of the drawings, a combination can crusher and can retriever 10 can be seen having a handle portion 11, a base portion 12 and a crushing portion 13. The handle portion 11 comprises an elongated offset tubular member 14 with a contoured grip 15 formed inwardly from the free end thereof. The base 12 has a contoured can receiving area 12 integrally formed with a tubular handle engagement portion 17 as best seen in FIGS. 3 and 6 of the drawings. A pair of upstanding apertured lugs 18 extend from said tubular handle portion 17 adjacent said can receiving area 16. The lugs 18 are in aligned horizontal spaced relation to one another and define a pivot point for said crushing portion 13 which is positioned therebetween.

The can receiving area 16 is of a generally rectangular contoured configuration for registration of a can 20 within.

Figures 1, 2:
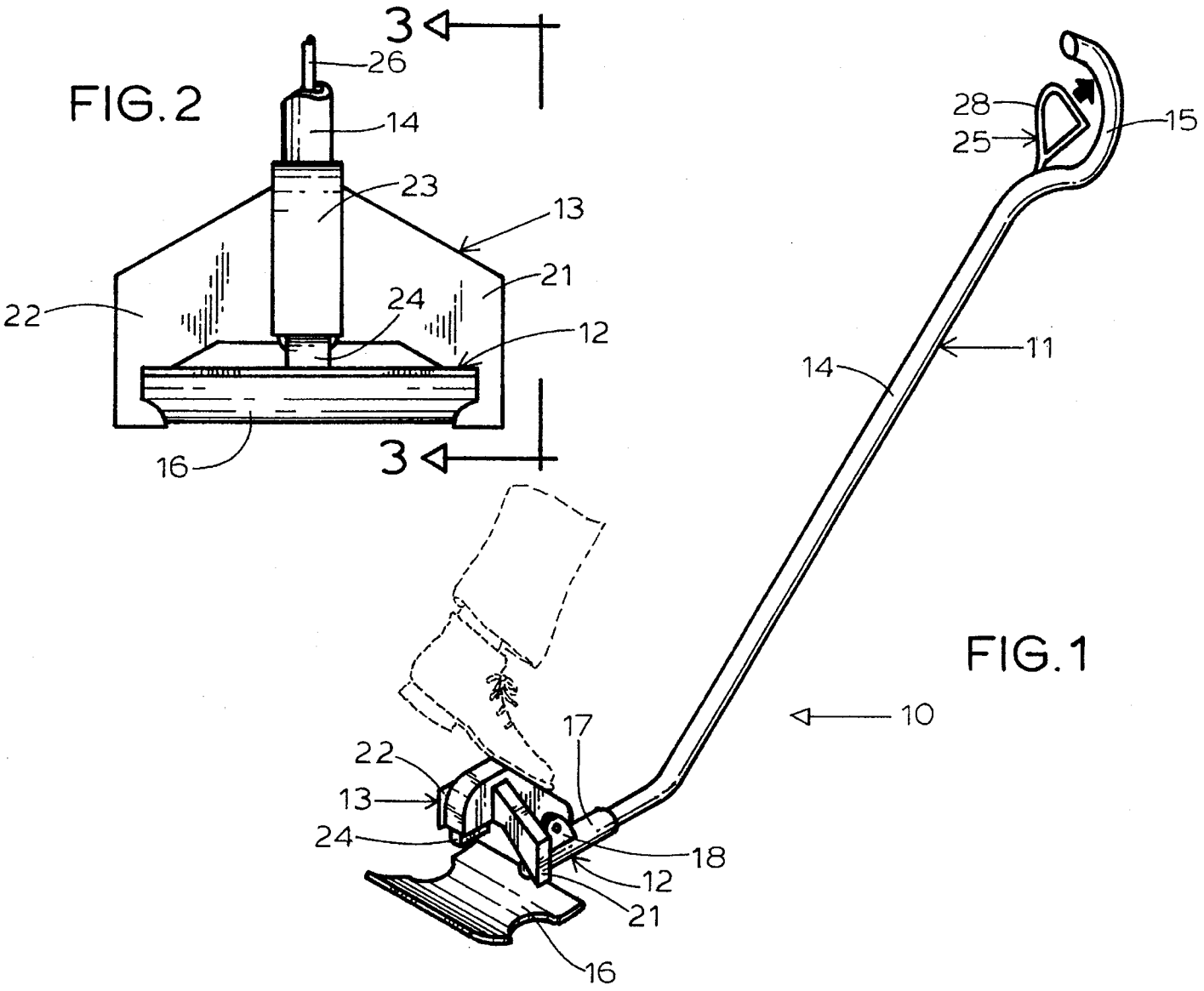
FIG. 1 is a perspective top, side and front plan view of the combination can crusher and retaining device.
FIG. 2 is an enlarged front elevational view of the lower portion of the invention.

Referring to FIGS. 2 and 3 of the drawings, the crushing portion 13 can be seen having a pair of oppositely disposed guide arms 21 and 22 extending from an apertured movable jaw member 23 which is pivotally secured through said aperture at one end thereof between said upstanding apertured lugs 18 by a pivot pin 23A.

A crushing block 24 extends from the movable jaw member 23 in transverse aligned position to the longitudinal axis of the can receiving area 16 hereinbefore described.

Referring now to FIGS. 1 and 3 of the drawings, a jaw activation assembly 25 can be seen having a cable 26 extending through said tubular member 14 of the handle portion 11 and the tubular handle engagement portion 17 of the base 12. The cable 26 is secured at one end to the movable jaw member 23 at 27 and to a cable handle 28 positioned on the opposite end of the cable 26 within the contoured grip portion 15 of the tubular member 14.

Figure 4:
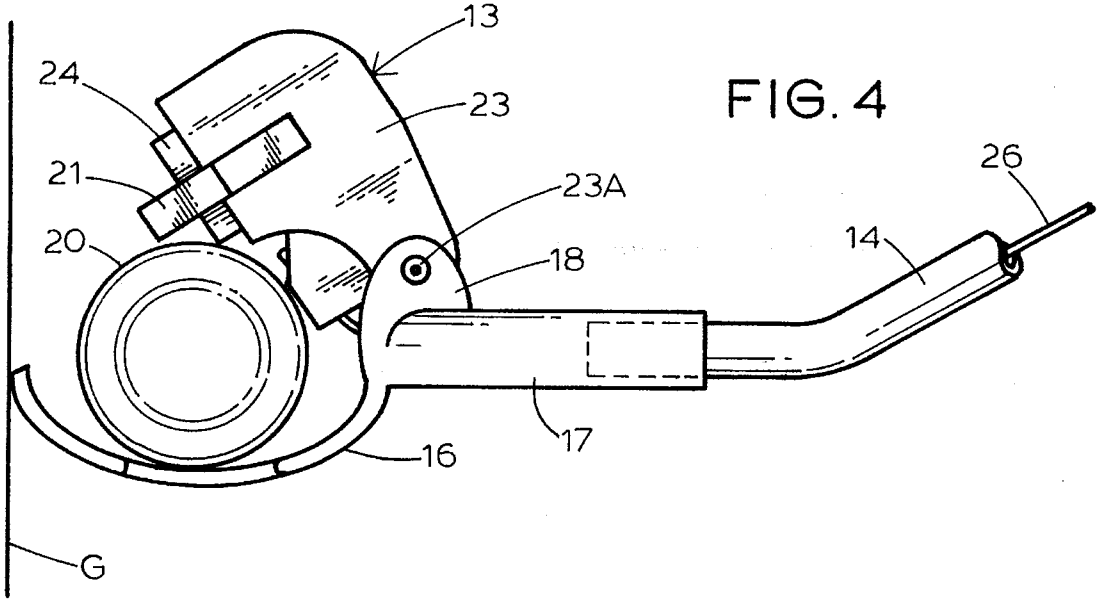
FIG. 4 is an enlarged side elevational view of the lower portion of the invention engaging a can to be crushed.
Figure 5:
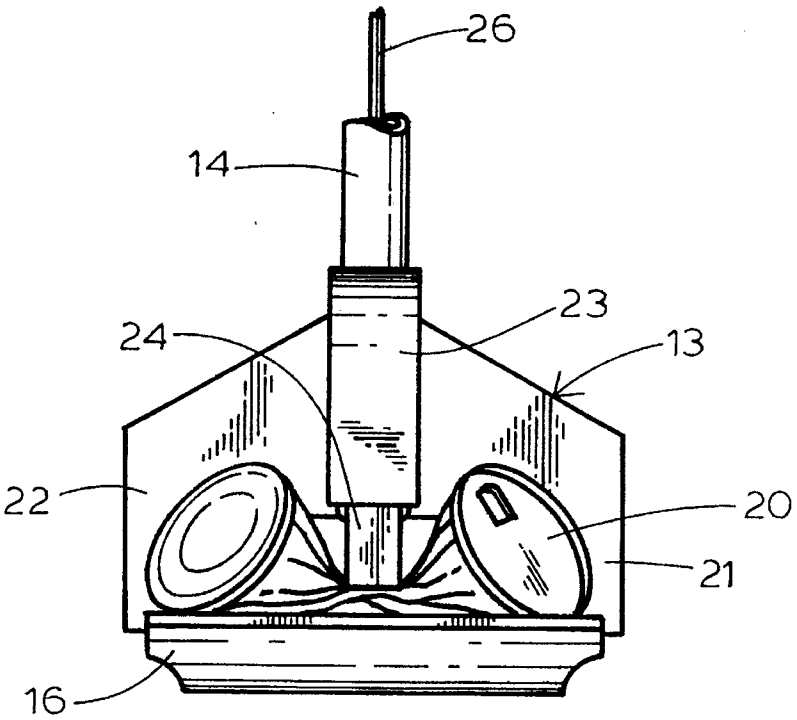
FIG. 5 is an enlarged front plan view of the lower portion of the invention after crushing of the can has taken place.

In use, the combined can crusher and can retriever of the invention is positioned in vertical alignment to engage the can 20 on the ground G to be crushed as best seen in FIG. 4 of the drawings. The can 20 may be initially held in place by retraction of the cable 26 by the manual movement of the cable handle 28 as required and illustrated by the directional arrow in FIG. 1 of the drawings. The movable jaw member 23 pivots arcuately as indicated by the directional error in FIG. 3 of the drawings so as to be engaged against the can 20. The crushing block 24 engages the can 20 crushing same against the base portion's can receiving area 16 best seen in FIG. 5 of the drawings. The pressure required for the jaw 23 to crush the can 20 is imparted by the user's foot to push down against the movable jaw member 23 as is shown in broken lines in FIG. 1 of the drawings. Due to the alignment of the crushing block 24 midway along the can 20 the can's center portion 20A is initially engaged and crushed folding the can's respective ends inwardly. The guide arms 21 and 22 engage the can 20 and help fold the can's respective ends inwardly to control the crushing as well and prevent the can from being displaced longitudinally within the contoured can receiving area 16 of the base.

It will be evident from the foregoing description that this combination of a can crusher and retriever provides for selective container positioning within the crushing parts and for engagement and transport of the container within the device both before and after the container is crushed.

It will be apparent to those skilled in the art that various changes and modifications may be changed within this invention without departing from the spirit of the invention, therefore

I claim:

1. A can crushing and retrieving device comprising, a contoured can positioning base member including a contoured can receiving portion, a movable jaw member pivotally secured to said base member, said movable jaw member having a pair of oppositely disposed guide arms extending therefrom, a can crushing block positioned between said guide arms on said movable jaw, a handle support means extending from said base member, a cable secured to and extending from said movable jaw to a cable handle in said handle support means.

2. The can crushing and retrieving device of claim 1 wherein said contoured can positioning base member is of a generally rectangular configuration and is in spaced alignment with said movable jaw.

3. The can crushing and retrieving device of claim 1 wherein said handle support means comprises, an elongated angular offset tubular member extending from said contoured can positioning base member.

4. The can crushing and retrieving device of claim 1 wherein said movable jaw is pivotally secured to said base adjacent said contoured can receiving portion.

5. The can crushing and retrieving device of claim 1 wherein said guide arms extend angularly from said movable jaw and are in spaced oppositely disposed longitudinal alignment with said contoured can receiving portion.

* * * * *